US005261249A

United States Patent [19]

Manz et al.

[11] Patent Number: 5,261,249

[45] Date of Patent: Nov. 16, 1993

[54] REFRIGERANT HANDLING SYSTEM WITH AUXILIARY CONDENSER FLOW CONTROL

[75] Inventors: Kenneth W. Manz, Paulding; Christopher M. Powers, Bryan, both of Ohio

[73] Assignee: SPX Corporation, Muskegon, Mich.

[21] Appl. No.: 977,083

[22] Filed: Nov. 16, 1992

[51] Int. Cl.[5] ..... F25B 45/00

[52] U.S. Cl. ..... 62/149; 62/292; 62/475; 62/196.4

[58] Field of Search ..... 62/196.4, 173, 77, 149, 62/292, 195

[56] References Cited

U.S. PATENT DOCUMENTS

| | | | |
|---|---|---|---|
| 3,139,735 | 7/1964 | Malkoff | 62/173 |
| 4,261,178 | 4/1981 | Cain | 62/149 |
| 4,646,527 | 3/1987 | Taylor | 62/85 |
| 4,768,347 | 9/1988 | Manz et al. | 62/149 |
| 4,805,416 | 2/1989 | Manz et al. | 62/292 |
| 5,065,595 | 11/1991 | Seener et al. | 62/212 |
| 5,099,653 | 3/1992 | Major et al. | 62/149 |
| 5,193,351 | 3/1993 | Laukhuf et al. | 62/195 |

OTHER PUBLICATIONS

Sporlan Valve Company, "Head Pressure Control Valves," Bulletin 90-30 (Sep. 1986).

Sporlan Valve Company, "Type LAC-4 Head Pressure Control Valve," Bulletin 90-30-2 (Feb. 1990).

*Primary Examiner*—John M. Sollecito

*Attorney, Agent, or Firm*—Barnes, Kisselle, Raisch, Choate, Whittemore & Hulbert

[57] ABSTRACT

A refrigerant handling system that includes a compressor and an evaporator for adding heat to refrigerant fed to the compressor inlet. A first condenser is connected to the compressor outlet and disposed in heat exchange relationship to the evaporator for at least partially condensing refrigerant vapor from the compressor outlet by transfer of heat to refrigerant in the evaporator. A second condenser is not in heat exchange relationship with the evaporator. The first and second condensers are connected in series with the compressor outlet, and one or more valves are connected to the second condenser for selectively bypassing refrigerant from the second condenser, while all refrigerant from the compressor outlet flows through the first condenser that is in heat exchange relation to the evaporator.

22 Claims, 7 Drawing Sheets

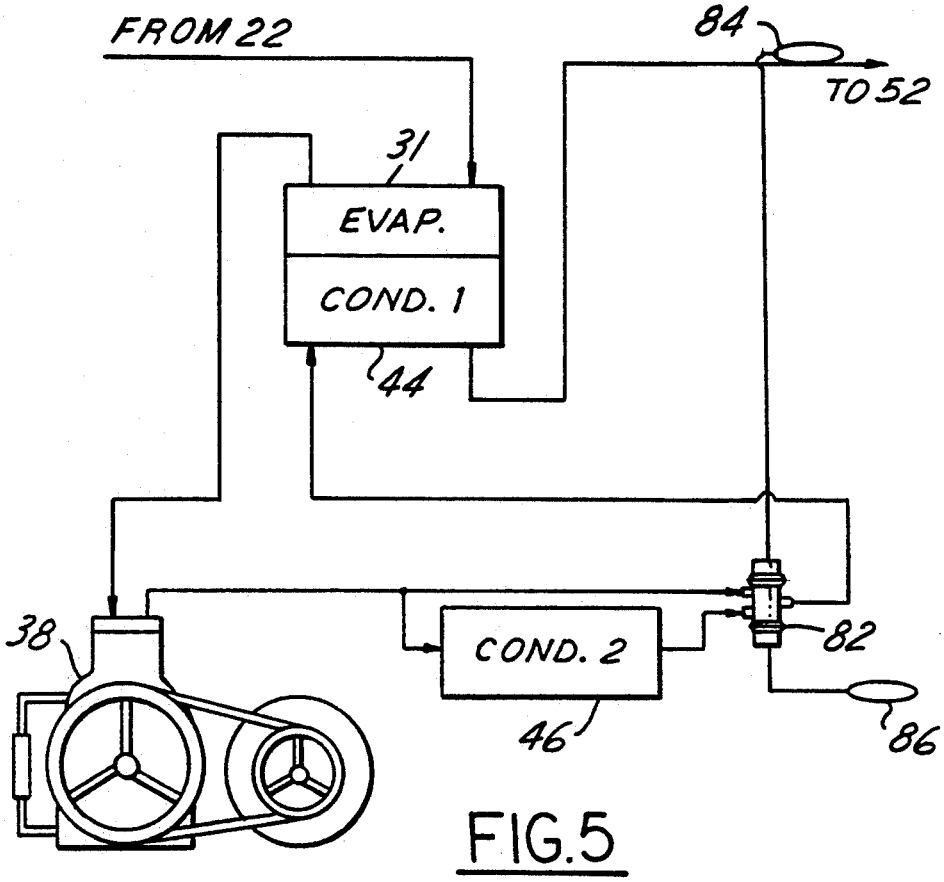
FIG.5
FIG.6
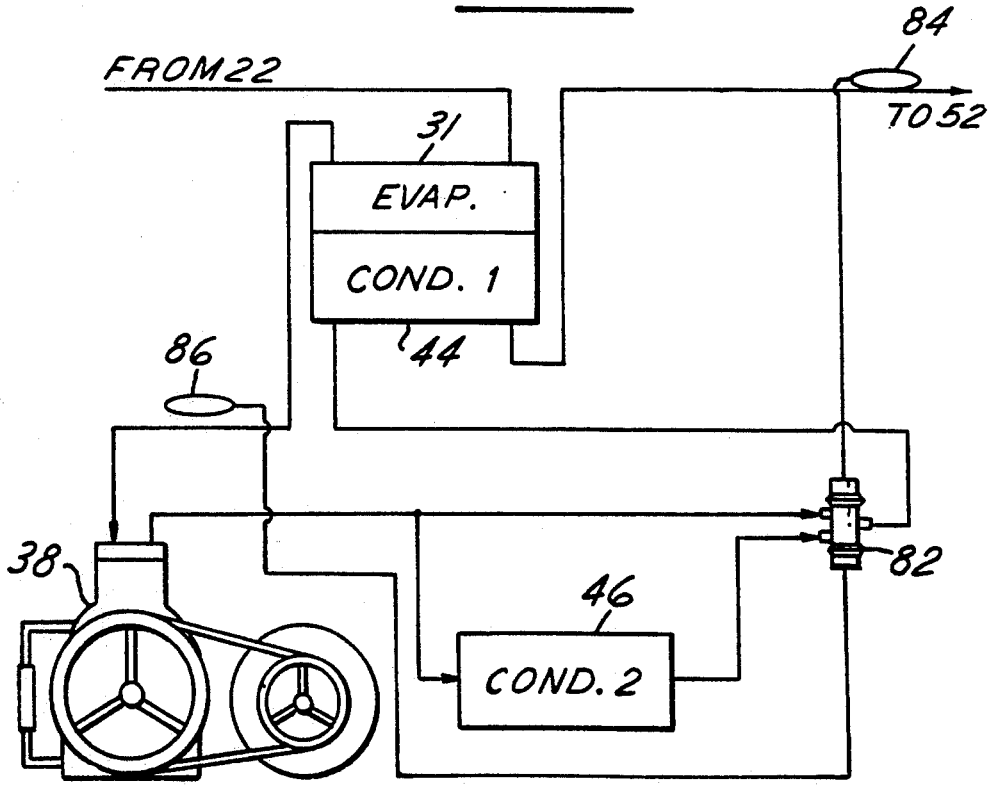

REFRIGERANT HANDLING SYSTEM WITH AUXILIARY CONDENSER FLOW CONTROL

The present invention is directed to refrigerant handling systems, particularly refrigerant recovery systems, in which refrigerant is pumped by a compressor from an evaporator through a condenser in heat exchange relationship with each other.

BACKGROUND AND OBJECTS OF THE INVENTION

Many scientists contend that release of halogen refrigerants into the atmosphere deleteriously affects the ozone layer that surrounds and protects the earth from ultraviolet solar radiation. Recent international discussions and treaties, coupled with related regulations and legislation, have renewed interest in devices for recovery and storage of used refrigerants from refrigeration equipment for later purification and reuse or for proper disposal. U.S. Pat. No. 4,261,178, assigned to the assignee hereof, discloses a refrigerant recovery system in which the inlet of a compressor is coupled through an evaporator and through a manual valve to the refrigeration equipment from which refrigerant is to be recovered. The compressor outlet is connected through a condenser to a refrigerant storage container. The condenser and evaporator are combined in a single assembly through which cooling air is circulated by a fan. Content of the storage container is monitored by a scale on which the container is mounted for sensing weight of liquid refrigerant in the container, and by a pressure switch coupled to the fluid conduit between the condenser and the container for sensing vapor pressure within the storage container. A full-container condition sensed at the scale or a high-pressure condition sensed at the pressure switch terminates operation of the compressor motor. A vacuum switch is positioned between the inlet valve and the evaporator for sensing evacuation of refrigerant from the refrigeration system and automatically terminating operation of the compressor motor.

U.S. Pat. No. 4,768,347, also signed to the assignee hereof, discloses a refrigerant recovery system that includes a compressor having an inlet coupled through an evaporator and through a solenoid valve to the refrigeration equipment from which refrigerant is to be withdrawn, and an outlet coupled through a condenser to a refrigerant storage container or tank. The refrigerant storage container is carried by a scale having a limit switch coupled to control electronics to prevent or terminate further refrigerant recovery when the container is full. The scale comprises a platform pivotally mounted by a hinge pin to a wheeled cart, which also carries the evaporator/condenser unit, compressor, control electronics, and associated valves and hoses. In the preferred embodiment, the condenser and evaporator are combined within a single assembly, in heat exchange relationship with each other, which also includes oil separation and oil drain facility.

U.S. Pat. No. 4,805,416 discloses refrigerant recovery and purification systems that include facility for operation of the compressor to withdraw recovered refrigerant from the storage container, circulate the refrigerant in a closed path through a filter/dryer, and then return the refrigerant to the storage container. A supplemental condenser may be positioned between the storage container and the primary condenser in the heat-exchange/oil-separator unit to provide enhanced condenser heat-rejection capability, and thereby facilitate extended operation of the unit in the purification mode without overheating the refrigerant or the compressor. All refrigerant from the compressor flows through both the primary condenser and supplemental condenser in both of the recovery and purification modes.

Although the systems disclosed in the noted patents address and overcome problems theretofore extant in the art, and have enjoyed substantial commercial acceptance and success, further improvements remain desirable. In particular, it has been found that, under some operating conditions, there is more heat to be withdrawn from the refrigerant at the condenser than is needed to obtain complete evaporation at the evaporator, leading either to undesirable superheating at the evaporator or less than complete condensation at the condenser. However, under other operating conditions for the same unit, heat exchange at the evaporator/condenser achieves the desired balance. It is therefore a general object of the present invention to provide a refrigerant handling system in which refrigerant flow through the condenser is controlled in such a way as to reduce undesirable superheating at the evaporator while at the same time obtaining maximum available heat withdrawal and condensation of refrigerant at the condenser. A more specific object of the present invention is to provide a system, particularly a refrigerant recovery system of the character described above, that operates at approximately 10° F. superheat at the evaporator, and that maintains refrigerant temperature at the condenser to less than 25° F. above ambient or 45° F. above evaporator temperature as appropriate.

SUMMARY OF THE INVENTION

A refrigerant handling system in accordance with the present invention includes a compressor and an evaporator for adding heat to refrigerant fed to the compressor inlet. A first condenser is connected to the compressor outlet and disposed in heat exchange relationship to the evaporator for at least partially condensing refrigerant vapor from the compressor by transfer of heat to refrigerant in the evaporator. A second condenser is not in heat exchange relationship with the evaporator. One or more valves are connected to the second condenser for selectively controlling refrigerant flow from the compressor outlet to the first and second condensers so as to maintain desired refrigerant condensing temperature—i.e., a maximum desired refrigerant temperature at the combined condenser outlet. In the preferred embodiments of the invention, the first and second condensers are connected in series with the compressor outlet, and the valves are connected for selectively bypassing refrigerant from the second condenser, while all refrigerant from the compressor outlet flows through the first condenser that is in heat exchange relation to the evaporator. In the preferred embodiments, the first or primary condenser is connected downstream of the second or supplemental condenser.

The flow control valves in the preferred embodiments of the invention are responsive to refrigerant temperature at the condensers for selectively bypassing refrigerant from the second or supplemental condenser while directing all refrigerant through the first or primary condenser in heat exchange relation to the evaporator. The flow control valve may comprise a head pressure control valve connected at the inlet of the second condenser and responsive to condensing pressure within the second condenser, which varies as a function of condensing temperature at the second condenser, for selectively bypassing refrigerant from flow through the second condenser. In another embodiment, the flow control valve comprises a solenoid valve responsive to electrical signals from a temperature sensor positioned for sensing refrigerant temperature at the outlet of the condensers.

In the preferred embodiments of the invention, the flow control valve comprises a thermostatic expansion valve having at least one control bulb positioned so as to be responsive to condenser refrigerant temperature, and valve elements for selectively feeding refrigerant to the second or supplemental condenser when an elevated refrigerant temperature at the condenser indicates need for supplemental condenser operation. The thermostatic expansion valve may also include a second control bulb positioned to be responsive to either evaporator temperature or ambient temperature so as to control refrigerant flow through the valve and supplemental condenser as a function of a temperature differential between condenser refrigerant temperature and either evaporator or ambient temperature.

BRIEF DESCRIPTION OF THE DRAWINGS

The invention, together with additional objects, features and advantages thereof, will be best understood from the following description, the appended claims and the accompanying drawings in which:

FIGS. 5–6 are fragmentary schematic diagrams similar to a portion of FIG. 1 but illustrating further modified embodiments of the invention;

DETAILED DESCRIPTION OF PREFERRED EMBODIMENTS

Figure 1:
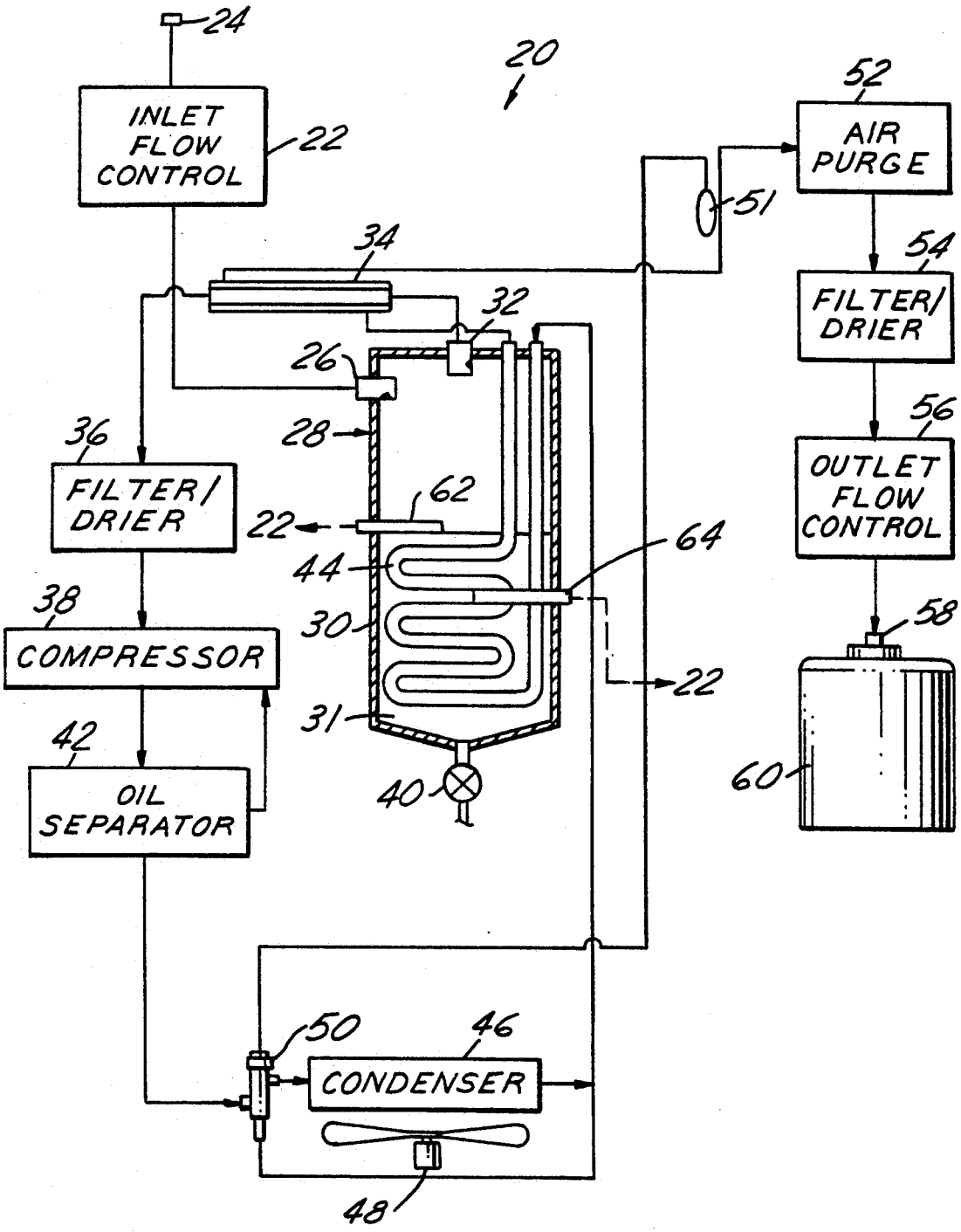
FIG. 1 is a schematic diagram of a refrigerant recovery system in accordance with one embodiment of the invention.

FIG. 1 illustrates a refrigerant recovery system 20 in accordance with one embodiment of the present invention as comprising inlet flow control hardware 22, including flow control valves, filters, etc., coupled to a connector 24 for connection to equipment under service from which refrigerant is to be withdrawn. Refrigerant from inlet flow control 22 is fed to an inlet port 26 at the upper portion of a heat-exchange/oil-separator unit 28. Unit 28 comprises a substantially cylindrical canister 30 having an open internal volume 31, with inlet port 26 and an outlet port 32 being mounted at the upper portion thereof and opening into the internal volume. From outlet port 32, refrigerant flows through a superheater 34 and a filter/dryer 36 to the inlet of a refrigerant compressor 38. An oil drain valve 40 is disposed at the bottom of canister 30. The outlet of compressor 38 is connected through a compressor oil separator 42 to a thermostatic expansion valve 50.

Valve 50 receives a control input from a refrigerant bulb 51, and has a pair of outlets. The first outlet is connected to a condenser coil 44 within canister 30. The second output of valve 50 is connected to coil 44 through a supplemental condenser 46 cooled by a fan 48. The output of coil 44 flows through a superheater 34 to air purge hardware 52. Bulb 51 is positioned to be in heat exchange with refrigerant flowing to air purge 52, so that the control pressure applied to valve 50 by bulb 51 is responsive to condenser outlet refrigerant temperature. From air purge 52, refrigerant is fed through a second filter/dryer 54 and outlet flow control hardware 56 to a connector 58 coupled to a refrigerant storage container 60. A pair of level sensors 62,64 are positioned within canister 30, and are coupled to flow control valves within inlet flow control hardware 22.

In general, connector 24 is connected to equipment from which refrigerant is to be recovered, and connector 58 is coupled to container 60. Fan 48 and compressor 38 are then energized, so that compressor 38 draws refrigerant from the equipment under service into open volume 31 of canister 30, in which heat exchange takes place between such inlet refrigerant and refrigerant flowing through condenser coil 44. Thus, internal volume 31 of canister functions as both an accumulator and an evaporator in which heat is withdrawn from refrigerant within coil 44 and added to refrigerant within the canister volume so as to vaporize inlet refrigerant while cooling and at least partially condensing refrigerant flowing through coil 44. Such vaporized refrigerant exits canister 30 at port 32, and is further heated within superheater 34 by heat exchange with refrigerant from condenser coil 44. The purpose of superheater 34 is to prevent condensation of refrigerant between the evaporator and the inlet of compressor 38 during operation at low ambient temperatures.

Compressed refrigerant vapor is fed from compressor 38 through valve 50 to condenser coil 44, and thence through superheater 34 to air purge 52. Depending upon the temperature of refrigerant at the condenser, to be described in connection with FIG. 2, all or a portion of such refrigerant may flow through supplemental condenser 46. In any event, refrigerant that is at least partially condensed flows to container 60 through air purge 52, filter/dryer 54 and outlet flow control 56. To the extent thus far described, with the exception of superheater 34, valve 50, bulb 51, supplemental condenser 46 and fan 48, system 20 hereinabove described is essentially the same as that disclosed in U.S. application Ser. No. 07/797,360 filed Nov. 25, 1991 and assigned to the assignee hereof, to which reference may be made for more detailed discussion of overall system construction and operation.

Figure 2:
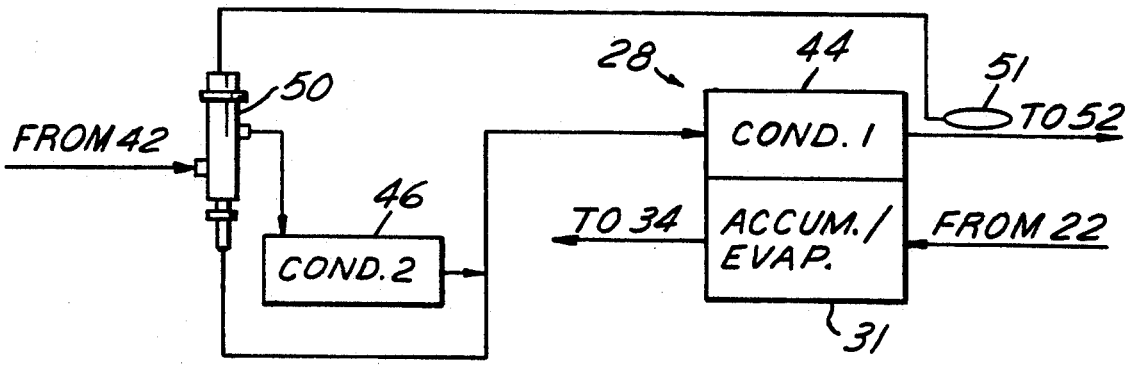
FIG. 2 is a fragmentary schematic diagram that illustrates a portion of FIG. 1.
Figure 3:
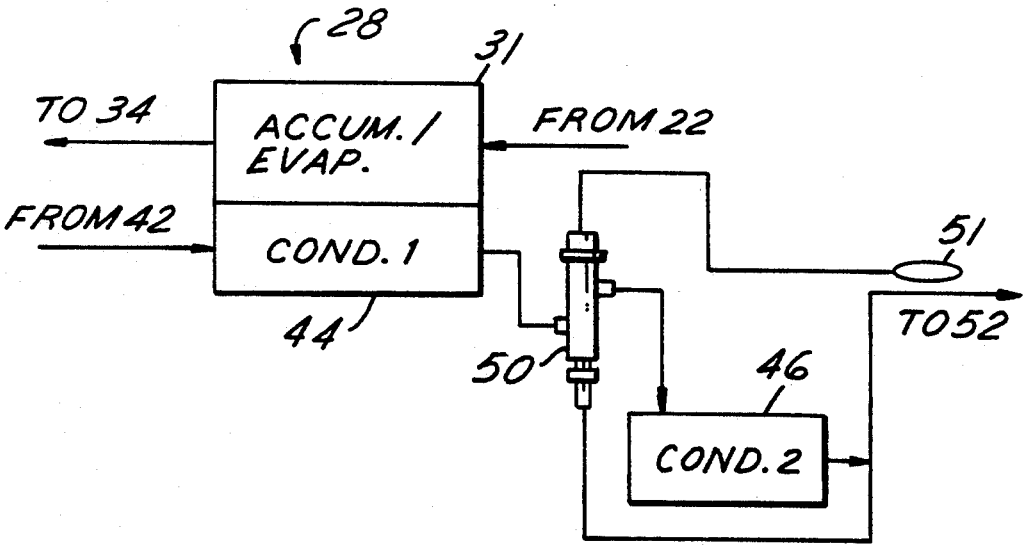
FIGS. 3 is a fragmentary schematic diagram similar to that of FIG. 2 but illustrating a modified embodiment of the invention.

FIG. 2 illustrates functional interconnection of accumulator/evaporator 31 with condenser coil 44, separate supplemental condenser 46, valve 50 and bulb 51. Valve 50 is set in conjunction with refrigerant vapor pressure in bulb 51 so that, when temperature of refrigerant to air purge 52 is sufficiently high to indicate a need for further condensation, some or all of the refrigerant from compressor oil separate 42 is routed through supplemental condenser 46. The amount of refrigerant fed through and/or bypassing condenser 46 is thus determined by combined (primary and secondary) condenser outlet refrigerant temperature. FIG. 3 illustrates a modification in which supplemental condenser 46 and valve 50 are positioned downstream of primary condenser 44, that is between primary condenser 44 and air purge 52. Bulb 51 is again positioned at the combined condenser outlet to air purge 52, and controls flow to feed all refrigerant through supplemental condenser 46, or partially or entirely to bypass the supplemental condenser, as a function of combined condenser outlet temperature.

Figure 4:
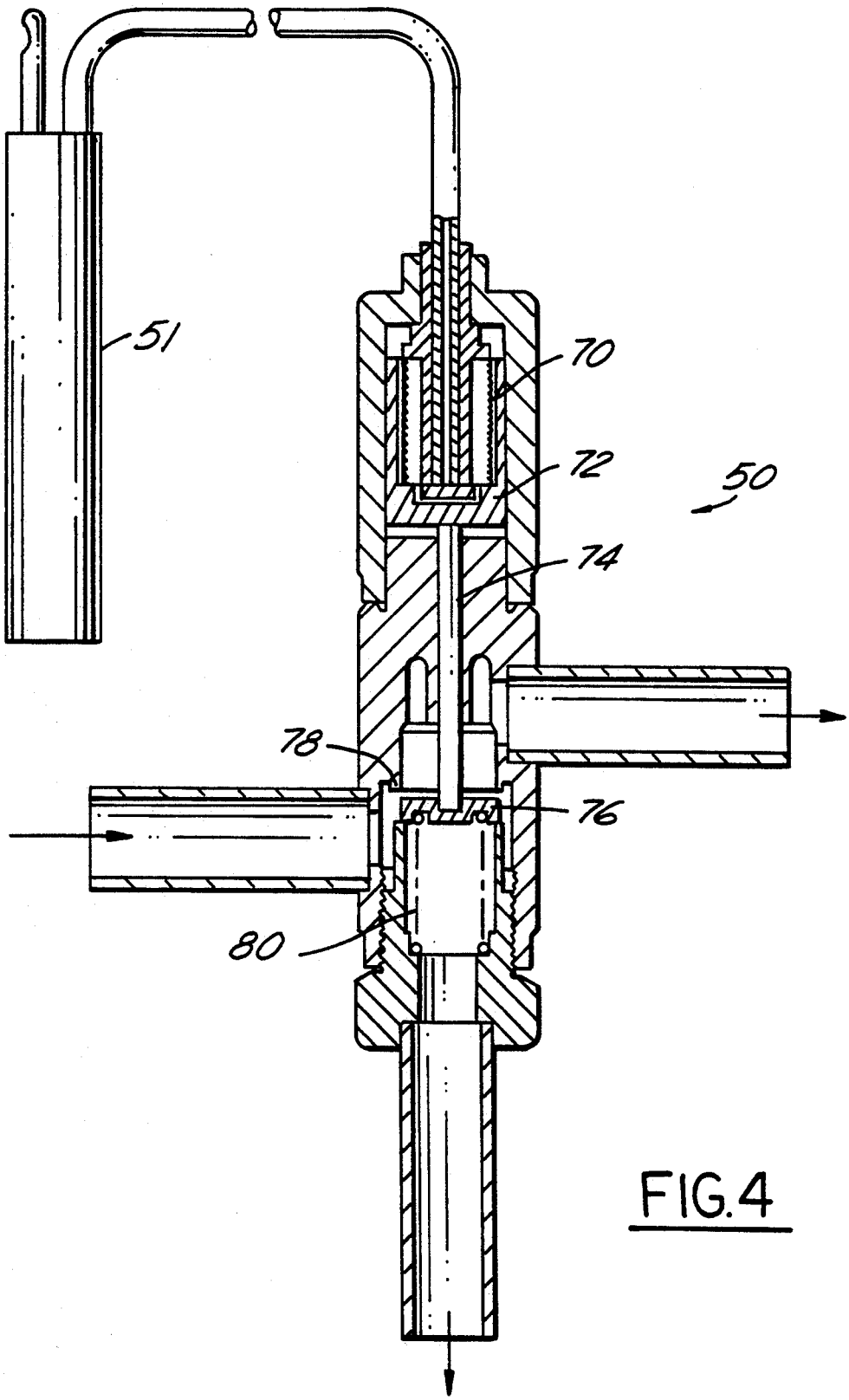
FIG. 4 is a sectional view that illustrates the flow control valve in the embodiments of FIGS. 2 and 3.

FIG. 4 illustrates valve 50 in greater detail. A bellows 70 is coupled on one side to bulb 51, and on the opposing side through a piston 72 to the valve stem 74. Valve stem 74 is coupled to a valve element 76, which opposes a valve seat 78. When valve element 76 is seated against seat 78 by the force of a coil spring 80, and when the condenser outlet temperature at bulb 51 is sufficiently low as not to overcome the spring force, flow from condenser 44 (FIGS. 1 and 2, through superheater 34) to supplemental condenser 46 is closed, and full flow takes place from condenser 44 to air purge 52 (FIG. 1) bypassing condenser 46. As the refrigerant pressure generated by bulb 51 begins to overcome the force of spring 80, valve element 76 moves away from seat 78, and some refrigerant begins to flow to supplemental condenser 46. In a preferred embodiment of the invention, valve 50 begins to open at a bulb temperature of 100° F., and is completely open as shown in FIG. 4 at a bulb temperature of 115° F.

FIGS. 5-6 illustrate embodiments of the invention that feature two-input dual-bulb thermostatic expansion valves 82. Each valve 82 has two control inputs connected to respective control bulbs 84,86, two flow inputs, and a single flow output. The output is connected to one or both of the flow inputs as a function of pressure differential, and therefore temperature differential, between the respective bulbs. Bulbs 84,86 contain the same type of refrigerant. In each FIG. 5-6, control bulb 84 is positioned so as to be responsive to condenser refrigerant temperature at the outlet of the combined primary/supplemental condensers. In FIG. 6, control bulb 86 is positioned at the outlet of the accumulator-/evaporator 31. The first flow input to valve 82 is connected to compressor 38 (through oil separator 42 in FIG. 1), while the second flow input is connected to supplemental condenser 46. Thus, valve 82 functions to permit flow either exclusively from primary condenser 44, exclusively from primary 44 and supplemental condenser 46 in series, or from an intermediate combination thereof, as a function of the difference between condenser and evaporator refrigerant temperatures. In the embodiment of FIG. 5, control bulb 86 is positioned so as to be responsive to ambient temperature, so that valve 82 controls flow of refrigerant through or around supplemental condenser 46 as a function of a difference between condenser refrigerant temperature and ambient temperature.

Figure 8:
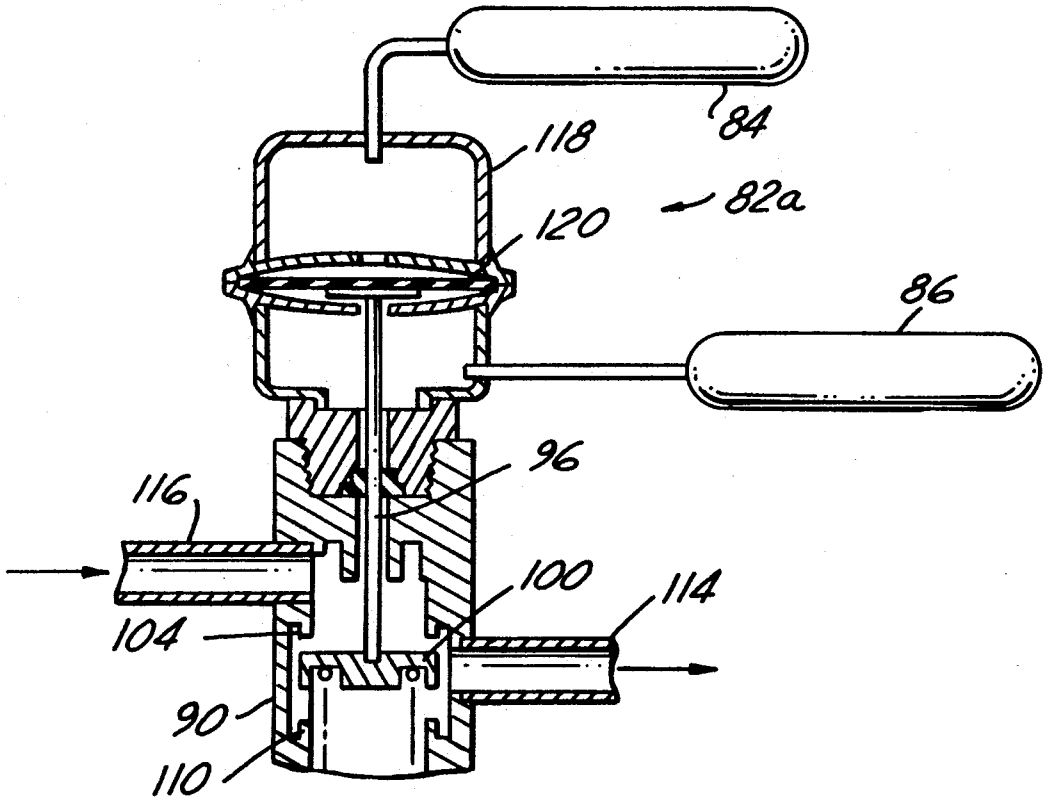
FIGS. 7 and 8 are schematic drawings that illustrate respective flow control valves that may be employed in the embodiments of FIGS. 5–6.
Figure 7:
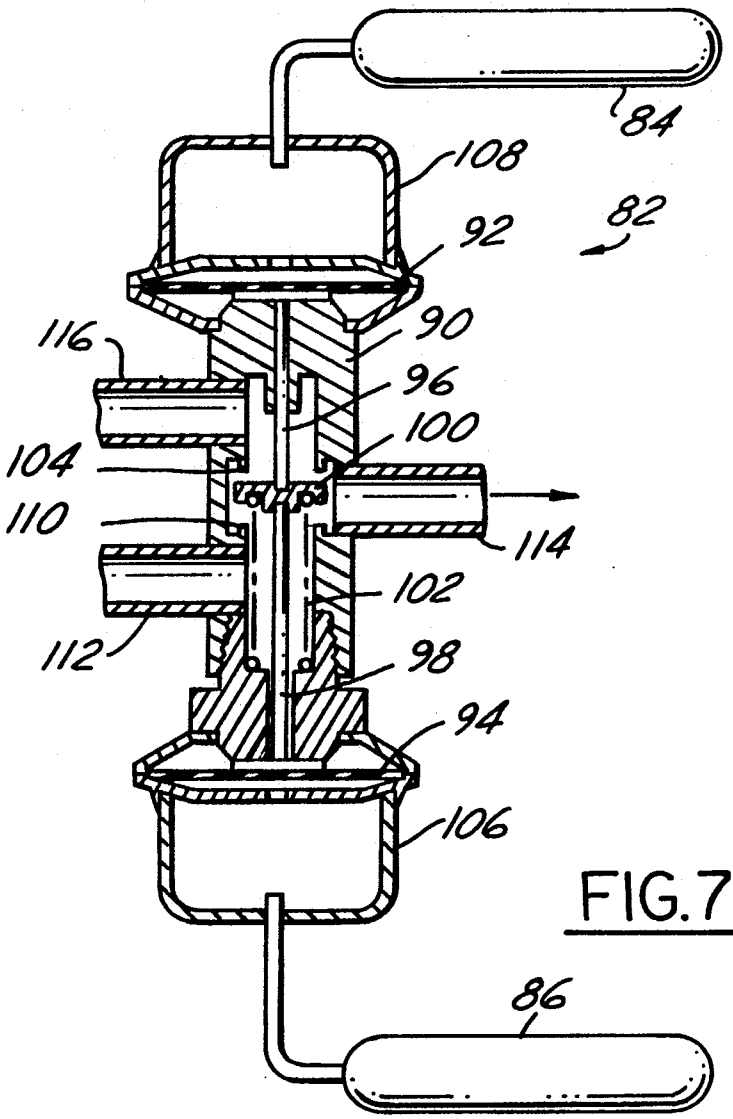

FIG. 7 illustrates a valve 82 suitable for use in the systems illustrated in FIG. 5-6. A valve body 90 has a pair of diaphragms 92,94 mounted at opposed ends. Diaphragms 92,94 are coupled to pushrods 96,98 that oppositely engage a valve element 100. Valve element 100 is urged by a coil spring 102 against an opposing valve seat 104 within valve body 90. Pressure of refrigerant from bulb 86 to dome 106 on the opposing side of diaphragm 94 assists spring 102, while pressure of refrigerant within bulb 84 and dome 108 opposes spring 102 and urges valve element 100 against the opposing seat 110. Thus, with valve element 100 against seat 104, second flow input 112 is connected to flow output 114, while flow input 116 is coupled to output 114 when valve element 100 is against seat 110. At any intermediate position of valve element 100, each input 112,116 is partially connected to output 114. FIG. 8 illustrates a modified valve 82*a* in which both control bulbs 84,86 are connected to a single dome 118 spanned by a diaphragm 120. Diaphragm 120 is coupled to pushrod 96 that engages valve element 100 as previously described.

Figure 9:
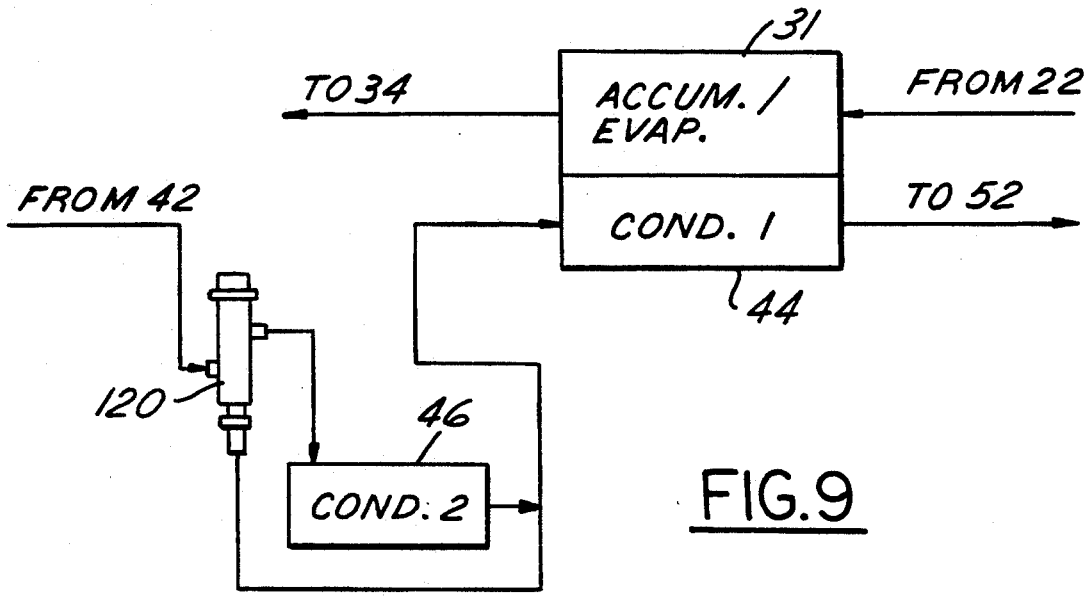
FIGS. 9–11 are fragmentary schematic diagrams that illustrates further embodiments of the invention.

FIG. 9 illustrates an embodiment in which the condenser flow control valve takes the form of an otherwise generally conventional head pressure control valve 120, such as an LAC-4 valve marketed by Sporlan Valve Company of St. Louis, Missouri. When the pressure of refrigerant at the outlet of compressor oil separator 42 is high, which also means a high condenser refrigerant temperature, valve 120 is throttled such that all refrigerant is routed through supplemental condenser 46, and thence through primary condenser 44 to air purge 52 (FIG. 1). On the other hand, as the compressor outlet temperature and pressure fall, indicating a reduced need for supplemental condensation, valve 50 closes flow to supplemental condenser 46 while opening direct flow to primary condenser 44 and air purge 52, until ultimately supplemental condenser 46 is bypassed entirely. Valve 120 is set so that the outlet refrigerant pressure from condensers 44,46 in combination is maintained at a desired level, such as 180 psig. The corresponding condenser temperature varies with refrigerant type—e.g., 130° F. for R12 and 95° F. for R22. Thus, maximum condenser outlet temperature is controlled indirectly in this embodiment by controlling maximum condenser outlet pressure.

Figure 10:
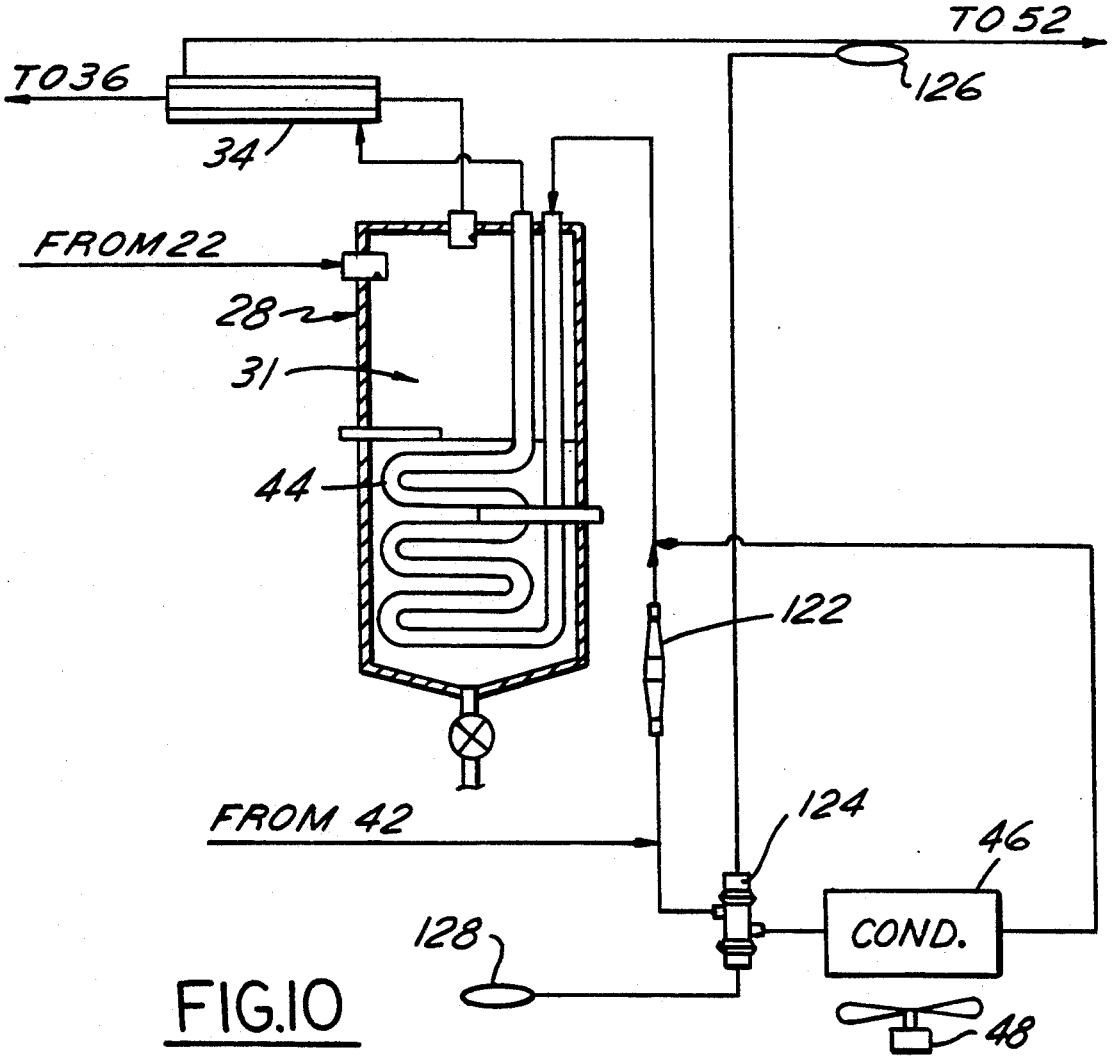

FIG. 10 illustrates an embodiment of the invention in which supplemental condenser 46 is located upstream of primary condenser 44, and a head pressure control valve 122 is connected across condenser 46 and condenser flow control valve 124. Valve 122 opens to flow when the inlet pressure exceeds the outlet pressure by a preset amount, preferably in the range of 20 psi to open to 30 psi for full flow. Valve 122 may comprise a Sporlan ORD valve. Valve 124 is a dual-bulb thermostatic expansion valve, and may be of the type disclosed in U.S. Pat. No. 5,065,595, for example. A first control bulb 126 is disposed so as to be responsive to temperature of refrigerant at the outlet side of condenser 44. The second control bulb 128 is disposed so as to be responsive to ambient temperature. Each bulb 126,128 contains refrigerant that produces a pressure which reflect the respective bulb temperatures, and valve 124 controls flow of refrigerant as a function of a difference between such temperatures (and pressures). Thus, when the outlet temperature from primary condenser 44 is well above ambient, indicating a need for further condenser capacity, valve 124 opens flow to supplemental condenser 46 to obtain such additional condenser capacity. On the other hand, as the outlet refrigerant temperature from condenser 44 decreases toward ambient, valve 124 reduces flow through supplemental condenser 46, and a greater amount of refrigerant bypasses condenser 46 and flows directly to condenser 44. Thus, valve 124 with bulbs 126,128 maintains condenser refrigerant temperature to a desired differential above ambient, such as 25° F. maximum.

Figure 11:
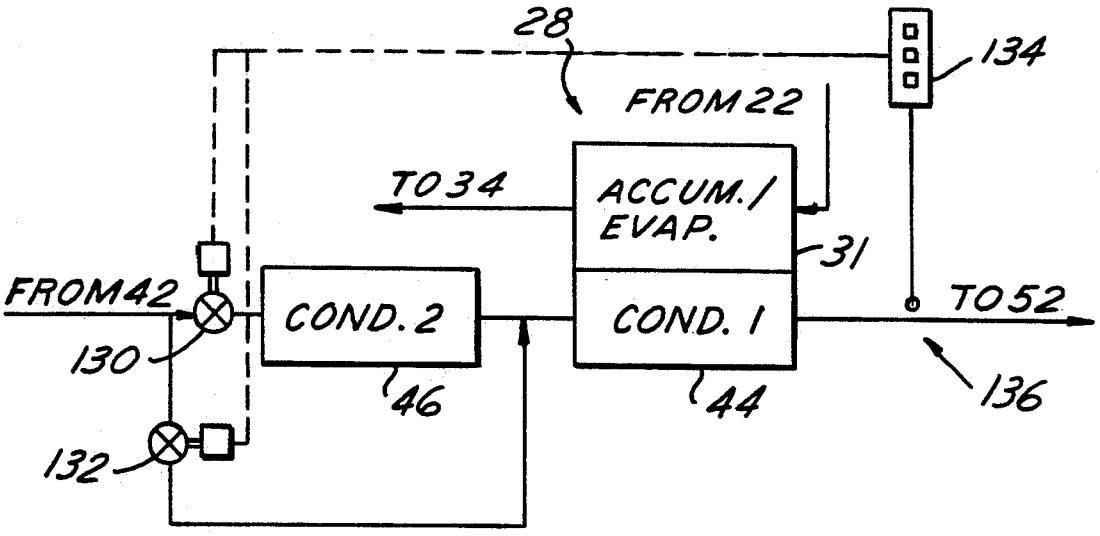

FIG. 11 illustrates an embodiment of the invention in which flow of refrigerant through or around supplemental condenser 46 is controlled by a pair of solenoid valves 130,132. Valve 130 controls direct flow from oil separator 42 through supplemental condenser 46 to primary condenser 44, and valve 132 controls flow bypassing condenser 46. A temperature sensor 134 has a probe 136 disposed so as to be responsive to refrigerant temperature at the outlet of primary condenser 44, and provides electrical signals to control operation of valves 130,132. When condenser refrigerant temperature is high, indicating a need for supplemental condenser capacity, sensor 134 opens valve 130 and closes valve 132 so that refrigerant is fed through supplemental condenser 46. On the other hand, as condenser refrigerant temperature falls, flow through valve 130 is throttled, and valve 132 provides increasing bypass flow around condenser 46. Both valves 130,132 preferably comprise proportional control valves that, in combination with suitable control at sensor 134, yield proportional flow control through or around supplemental condenser 46 as a function of combined condenser outlet temperature. Sensor 134 may receive a second temperature input indicative of ambient or evaporator temperature, and may control valves 130,132 as a function of temperature differential as hereinabove described.

We claim:

1. A refrigerant handling system that includes a compressor having an inlet and an outlet, evaporator means for adding heat to refrigerant fed to said compressor inlet, and condensing means for at least partially condensing refrigerant from said compressor outlet by extraction of heat, including first condenser means in heat exchange relationship with said evaporator means, characterized in that said condensing means further comprises second condenser means and means responsive to temperature of refrigerant at said condensing means for automatically controlling refrigerant flow from said compressor outlet to said first and second condenser means so as to maintain a desired refrigerant condensing temperature.

2. The system set forth in claim 1 wherein said condensing means further comprises means connecting said first and second condenser means in series to said compressor outlet, and wherein said flow-controlling means comprises means for selectively bypassing refrigerant from said second condenser means while all refrigerant from said compressor outlet flows through said first condenser means.

3. The system set forth in claim 2 wherein said first condenser means is connected between said second condenser means and said compressor outlet.

4. The system set forth in claim 2 wherein said second condenser means is connected between said first condenser means and said compressor outlet.

5. The system set forth in claim 1 wherein said second condenser means is not in heat exchange relationship with said evaporator means.

6. The system set forth in claim 1 wherein said flow-controlling means comprises a head pressure control valve connected at the inlet of said second condensing means and responsive to condensing pressure at said second condenser means, which varies as a function of condensing temperature at said second condenser means, for selectively bypassing refrigerant from flow through said second condenser means.

7. The system set forth in claim 6 wherein said first condenser means is connected between said second condenser means and said compressor outlet.

8. The system set forth in claim 1, wherein said flow-controlling means comprises temperature sensing means responsive to refrigerant temperature at said condensing means for providing an electrical signal, and valve means responsive to said electrical signal for selectively bypassing refrigerant from said second condenser means.

9. The system set forth in claim 8 wherein said temperature sensing means is responsive to outlet refrigerant temperature from said condensing means.

10. The system set forth in claim 8 wherein said signal-responsive means comprises a proportional valve.

11. The system set forth in claim 1 wherein said flow-controlling means comprises a thermostatic expansion valve having flow control valve means for selectively bypassing refrigerant from said second condenser means and a control bulb responsive to refrigerant temperature at said condensing means for controlling operation of said valve means.

12. The system set forth in claim 11 wherein said valve has first and second control bulbs, said valve means being responsive to a temperature differential between said bulbs, a first of said bulbs being disposed so as to be responsive to refrigerant temperature at said condensing means.

13. The system set forth in claim 12 wherein said second bulb is positioned so as to be responsive to refrigerant temperature at said evaporator means, such that refrigerant is selectively bypassed from said second condenser means as a function of refrigerant temperature differential between said condensing means and said evaporator means.

14. The system set forth in claim 13 wherein said first condenser means is connected between said second condenser means and said compressor outlet.

15. The system set forth in claim 12 wherein said second bulb is disposed so as to be responsive to ambient temperature, such that refrigerant is selectively bypassed from said second condenser means as a function of temperature differential between ambient and refrigerant temperature at said condensing means.

16. The system set forth in claim 15 wherein said first condenser means is connected between said second condenser means and said compressor outlet.

17. The system set forth in claim 12 wherein said valve has first and second refrigerant inputs and a refrigerant output, and wherein said valve means is responsive to said temperature differential for variably connecting said output to said first and second inputs.

18. The system set forth in claim 17 wherein said first condenser means has an outlet connected to one of said inputs and to an inlet of said second condenser means, and wherein said second condenser means has an outlet connected to said second input.

19. The system set forth in claim 1 further comprising a superheater connected to said evaporator means and to said first condenser means for superheating refrigerant flowing to said compressor inlet to prevent condensation at low ambient temperatures.

20. The system set forth in claim 1 wherein said evaporator means and said first condenser means comprises a canister having an internal volume, said evaporator means comprising inlet and outlet ports on said canister that open into said volume, said first condenser means comprising a refrigerant coil disposed for heat exchange with refrigerant within said volume.

21. The system set forth in claim 20 further comprising an oil drain in said canister.

22. The system set forth in claim 1 for recovering refrigerant further comprising input means for connecting said evaporator means to equipment under service for withdrawing refrigerant therefrom, and output means for connecting said condensing means to a refrigerant storage container.

* * * * *